US007222846B2

(12) United States Patent
Horiuchi

(10) Patent No.: US 7,222,846 B2
(45) Date of Patent: May 29, 2007

(54) SHEET TAKE-OUT APPARATUS AND METHOD OF TAKING OUT SHEETS

(75) Inventor: Haruhiko Horiuchi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/813,114

(22) Filed: Mar. 31, 2004

(65) Prior Publication Data

US 2004/0251591 A1 Dec. 16, 2004

(30) Foreign Application Priority Data

Jun. 12, 2003 (JP) ..... 2003-168123

(51) Int. Cl.
*B65H 3/08* (2006.01)

(52) U.S. Cl. ..... 271/98; 271/5; 271/20; 271/97; 271/104; 271/112; 271/123; 271/309

(58) Field of Classification Search ..... 271/309, 271/20, 112, 123, 97, 5, 98, 104
See application file for complete search history.

(56) References Cited

U.S. PATENT DOCUMENTS 2,812,178 A * 11/1957 Hagren ..... 271/94
3,504,910 A * 4/1970 Spyropoulos ..... 271/98
3,572,686 A * 3/1971 Day ..... 271/9.13
3,726,454 A * 4/1973 Robbins ..... 225/99
3,861,668 A * 1/1975 Wood ..... 271/15
3,945,095 A * 3/1976 Herold et al. ..... 271/210
4,184,672 A * 1/1980 Watkins et al. ..... 271/105
4,317,563 A * 3/1982 Zimmerman et al. ..... 271/211
4,324,394 A * 4/1982 Mitzel et al. ..... 271/5
4,348,019 A * 9/1982 Stievenart et al. ..... 271/10.09
4,395,035 A * 7/1983 Hunt ..... 271/97
4,886,261 A * 12/1989 Jeschke ..... 271/11
4,951,933 A * 8/1990 Mitzel et al. ..... 271/146
4,978,416 A * 12/1990 Potter et al. ..... 156/571
5,135,213 A * 8/1992 Malachowski et al. ..... 271/104
5,704,607 A * 1/1998 Brotherston ..... 271/96
6,264,188 B1 * 7/2001 Taylor et al. ..... 271/98
6,345,921 B1 * 2/2002 Cheung ..... 400/627
6,543,759 B2 4/2003 Yamaguchi et al.

(Continued)

FOREIGN PATENT DOCUMENTS

GB 2207422 A * 2/1989

(Continued)

*Primary Examiner*—Gene O. Crawford
*Assistant Examiner*—Leslie A. Nicholson, III
(74) *Attorney, Agent, or Firm*—Pillsbury Winthrop Shaw Pittman LLP

(57) ABSTRACT

A sheet take-out apparatus is disclosed that includes a sheet-feeding member on which sheets are placed. The apparatus includes an air spout unit to spout out air towards a right or left side of a front portion of the sheets with respect to a take-out direction of the sheets. A take-out unit takes out one sheet from in a predetermined take-out direction. A depression member depresses the sheets against the sheet-feeding member on a rear portion of the sheets. In addition, a method is disclosed for taking-out sheets by means of a sheet take-out apparatus. The sheet take-out apparatus and method are capable of taking out one necessary sheet at a time, regardless of surface conditions of the sheet.

12 Claims, 6 Drawing Sheets

U.S. PATENT DOCUMENTS

| | | | | |
|---|---|---|---|---|
| 6,609,708 | B2 * | 8/2003 | Moore et al. | 271/98 |
| 6,669,187 | B1 * | 12/2003 | Clark | 271/98 |
| 6,793,217 | B2 * | 9/2004 | Grønbjerg | 271/197 |
| 6,863,272 | B2 * | 3/2005 | DiNatale et al. | 271/97 |
| 2002/0047235 | A1 * | 4/2002 | Allner et al. | 271/98 |

FOREIGN PATENT DOCUMENTS

| | | | |
|---|---|---|---|
| JP | 62140948 | A * | 6/1987 |
| JP | 01092138 | A * | 4/1989 |
| JP | 02013530 | A * | 1/1990 |
| JP | 8-151135 | | 6/1996 |
| JP | 9-110207 | | 4/1997 |
| JP | 10-101239 | | 4/1998 |
| JP | 10-250881 | | 9/1998 |

* cited by examiner

SHEET TAKE-OUT APPARATUS AND METHOD OF TAKING OUT SHEETS

FIELD OF THE INVENTION

This invention generally relates to a sheet take-out apparatus and a method of taking out sheets, and, more particularly, to a sheet take-out apparatus and a method that successively takes out one sheet at a time from a bundle of stacked sheets.

This application is based upon and claims the benefit of priority from the prior Japanese Patent Application No. 2003-168123, filed on Jun. 12, 2003, the entire contents of which are incorporated herein by reference.

BACKGROUND OF THE INVENTION

In general, a sheet-handling device that carries out predetermined treatments is required to securely take out one sheet at a time from a bundle of stacked sheets. In compliance with the requirement a prior art sheet-handling device proposed up to now is provided with a take-out apparatus to prevent taking-out two sheets or more, i.e., a multi-sheet take-out prevention apparatus disclosed in Japanese Unexamined Patent Applications Tokkaihei 8-151135, Tokkaihei 9-110207, Tokkaihei 10-101239, Tokkaihei 10-250881.

Briefly, the sheet take-out apparatus disclosed in the Japanese Unexamined Patent Applications is provided with an air spout unit to spout air to a bundle of sheets, a take-out unit to suck a forward edge portion of a sheet and take it out from the bundle of sheets, and a depression unit disposed in the vicinity of the take-out unit to depress another forward edge portion of the sheets against the take-out unit. The sheet take-out apparatus particularly in Japanese Unexamined Patent Application Tokkaihei 10-101239 detects accompanied sheets or sheet conditions and feeds such detected information back to a controller in a take-out unit to achieve the optimum sheet take-out condition by controlling the following: depressing force of a voice coil motor, displacement of a movable sheet-feeding member of a sheet-feeding member, sucking force of a chamber block, or an actuator to adjust a position of an air nozzle.

As set forth above, the sheet take-out apparatus disclosed in the Japanese Unexamined Patent Applications proves to be difficult in taking out only one sheet at a time from the bundle of sheets primarily because the depression unit depresses the forward edge portion of the sheets against the take-out unit so that sheets at the take-out position are not always easily separate from each other. In addition, however, since sheets may be crushed immediately under a sheet take-out rotor in the take-out apparatus disclosed in Japanese Unexamined Patent Application Tokkaihei 10-101239, air is not supplied there. This leads to large friction among the sheets so that multi-sheet take-out troubles arise easily. In the case that changes in friction coefficients depend on sheet surface conditions, the sheet take-out apparatus is readily subject to their influence and its robustness becomes low.

SUMMARY OF THE INVENTION

Accordingly, the present invention is for solving the problem set forth above and provides a sheet take-out apparatus and a method that, regardless of sheet surface conditions, is capable of securely preventing the taking out of a plurality of sheets at a time.

One aspect of the present invention is directed to a sheet take-out apparatus provided with a sheet-feeding member on which a bundle of sheets is placed, an air spout unit that spouts out air toward a side of the sheets depressed by said depression member, a sheet take-out unit to take out a sheet from the bundle of sheets toward which the air spout unit spouts the air, and a depression member that depresses the sheets against the sheet-feeding member on a rear edge side located behind a central potion of the sheets with respect to a taking-out direction of the take-out unit.

Another aspect of the present invention is directed to a method of taking out a sheet including placing a bundle of sheets on a sheet-feeding member, spouting out air toward a side of the depressed sheets, taking out a sheet from the sheets toward which the air is spouted, and depressing the sheets against the sheet-feeding member on a rear edge side located behind a central potion of the sheets with respect to a taking-out direction of the take-out unit.

BRIEF DESCRIPTION OF THE DRAWINGS

A more complete appreciation of the present invention and many of its attendant advantages will be readily obtained as the same becomes better understood by reference to the following detailed descriptions when considered in connection with the accompanying drawings, wherein.

DESCRIPTION OF THE PREFERRED EMBODIMENTS

Figure 1:
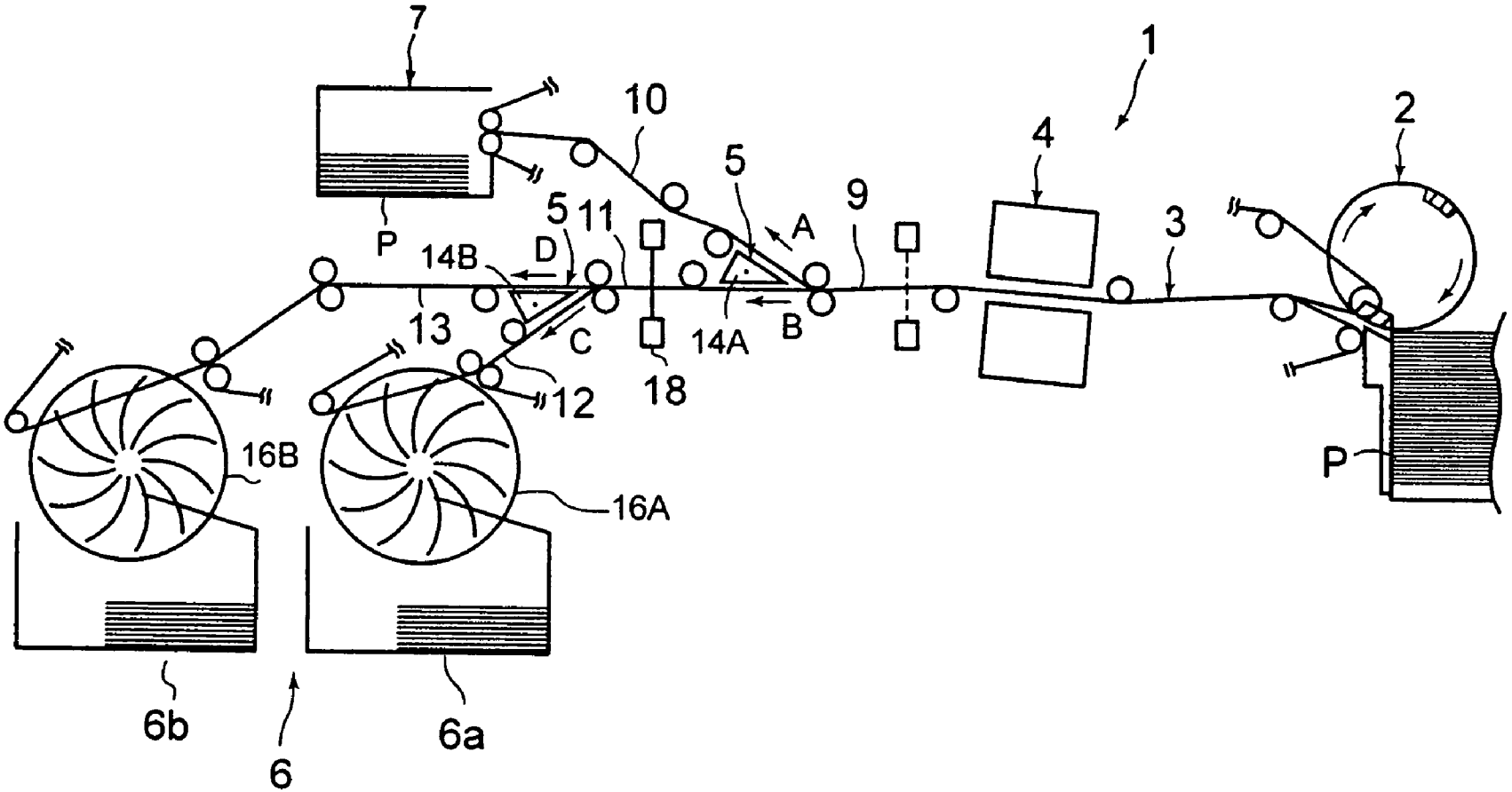
FIG. 1 is a schematic structure diagram of a sheet-handling system to which an embodiment of the present invention is applied.

Embodiments of the present invention will be explained below with reference to the attached drawings. It should be noted that the present invention is not limited to the embodiments but covers their equivalents. Throughout the attached drawings, similar or same reference numerals show similar, equivalent or same components. The drawings, however, are shown schematically for the purpose of explanation so that their components are not necessarily the same in shape or dimension as actual ones. In other words, concrete shapes or dimensions of the components should be considered as described in these specifications, not in view of the ones shown in the drawings. Further, some components shown in the drawings may be different in dimension or ratio from each other.

A sheet take-out apparatus and a method of taking out sheets of the first embodiment of the present invention will be explained below with reference to the attached drawings.

First, with reference to FIG. 1 an explanation will be provided for sheet-handling system 1 to which the present invention is applied. Sheet-handling system 1 successively takes out sheets from a bundle of stacked sheets and conveys them for further treatments, such as examination and classification of the sheets into usable and discard ones. By way of example, the sheet-handling rate of sheet-handling system 1 is tens of sheets per second while the conveying speed is several meters per second. The rate and speed are always constant.

As shown in FIG. 1, sheet-handling system 1 is provided with sheet take-out apparatus 2, conveyor 3, processing unit 4, separator 5, and the first and second stackers 6 and 7. Sheet take-out apparatus 2 successively takes out one sheet P at a time at a predetermined rate. Conveyor 3 coveys sheet P taken out by sheet take-out apparatus 2 in a predetermined direction. Processing unit 4 carries out a predetermined treatment for sheet P. In response to treatment information supplied from processing unit 4 separator 5 sends sheet P to either the first or second stacker 6 or 7 where sheet P is collected.

As will be set forth later in detail, sheet take-out apparatus 2 takes out one sheet P at a time from the upper portion of a bundle of "n" stacked sheets (n: an arbitrary integer). Sheet take-out apparatus 2 delivers the sheet P to conveyor 3, which conveys the same held by its conveying belts at a constant speed.

Processing unit 4 is disposed to face conveying path 9 in front of sheet take-out apparatus 2. Processing unit 4 examines the surface of sheet P taken out by sheet take-out apparatus 2 to check how much it is torn or how dirty it is. Consequently, processing unit 4 determines in light of results of such checking whether sheet P is still usable or must be discarded.

Separator 5 has the first gate 14A that sends sheets in conveying direction A or B in response to processing information supplied from processing unit 4 and the second gate 14B that sends sheets in conveying direction C or D in accordance with a predetermined number of conveyed sheets.

More particularly, the first gate 14A guides the sheets selected to be discarded in response to the processing information to the second stacker 7 through the first conveying branch 10. The first gate 14A also guides those determined to be still usable in response to the processing information to the first stacker 6 through the second conveying branch 11.

The second gate 14B, on the other hand, conveys the predetermined number of the sheets to the first stacker unit 6*a* of the first stacker 6 through the third conveying branch 12. The second gate 14B also conveys the predetermined number of the sheets to the second stacker unit 6*b* of the first stacker 6 through the fourth conveying branch 13.

The first stacker 6 has the first and second stacker units 6*a* and 6*b* provided with the first and second stacker wheels 16A and 16B, respectively. Stacker wheels 16A and 16B each consist of discs provided with curved grooves equally disposed around the center and stepping motors. Stacker wheels 16A and 16B are driven by the stepping motors, receive high-speed conveying sheets P and put them into the first and second stacker units 6*a* and 6*b* where bundles of sheets P are stacked again, respectively.

Passing number of sheets P conveyed to the first stacker 6 is counted by optical sensor 18 provided opposite to the second conveying branch 11. Whenever the number of sheets P is counted to a predetermined one, e.g., 100, the second gate 14B is turned to alternatively stack 100 sheets at the first stacker unit 6*a* or the second stacker unit 6*b*.

The second stacker 7 receives conveying sheets P to stack a bundle of sheets P again. The sheets stacked are then cut out by a shredder for discarding.

Figure 2:
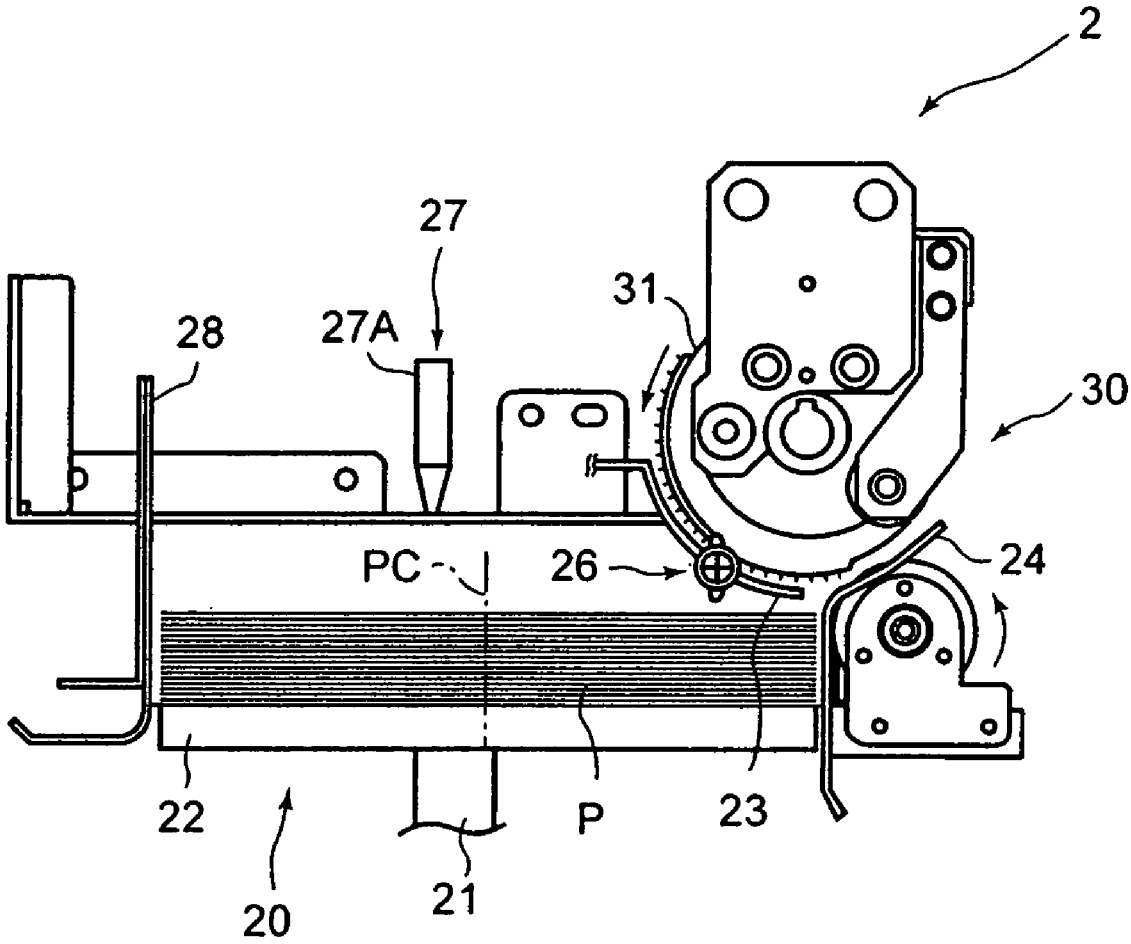
FIG. 2 is a schematic side view of an embodiment of a sheet take-out apparatus according to the present invention.
Figure 3:
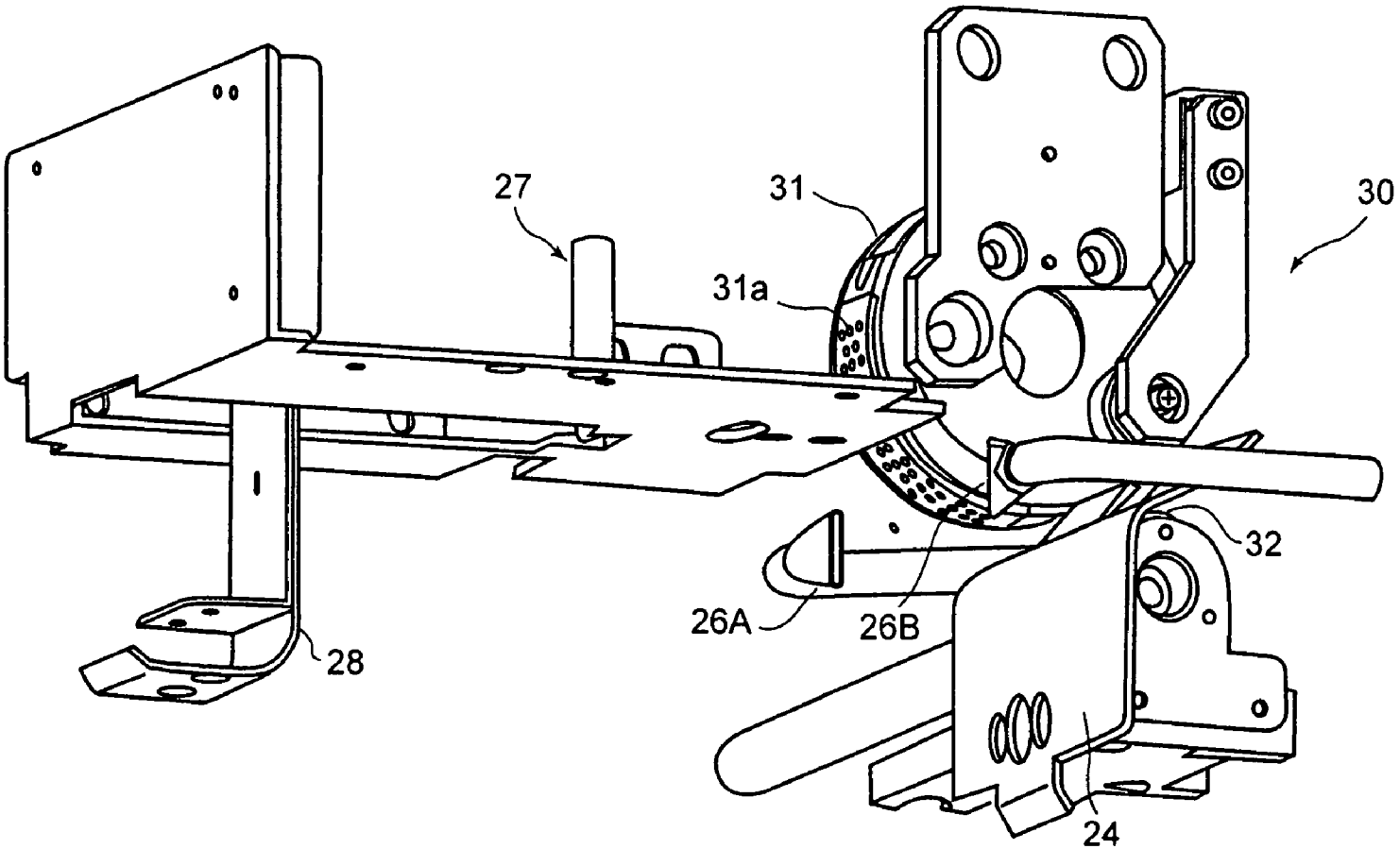
FIG. 3 is a schematic perspective view of the sheet take-out apparatus shown in FIG. 2.
Figure 4:
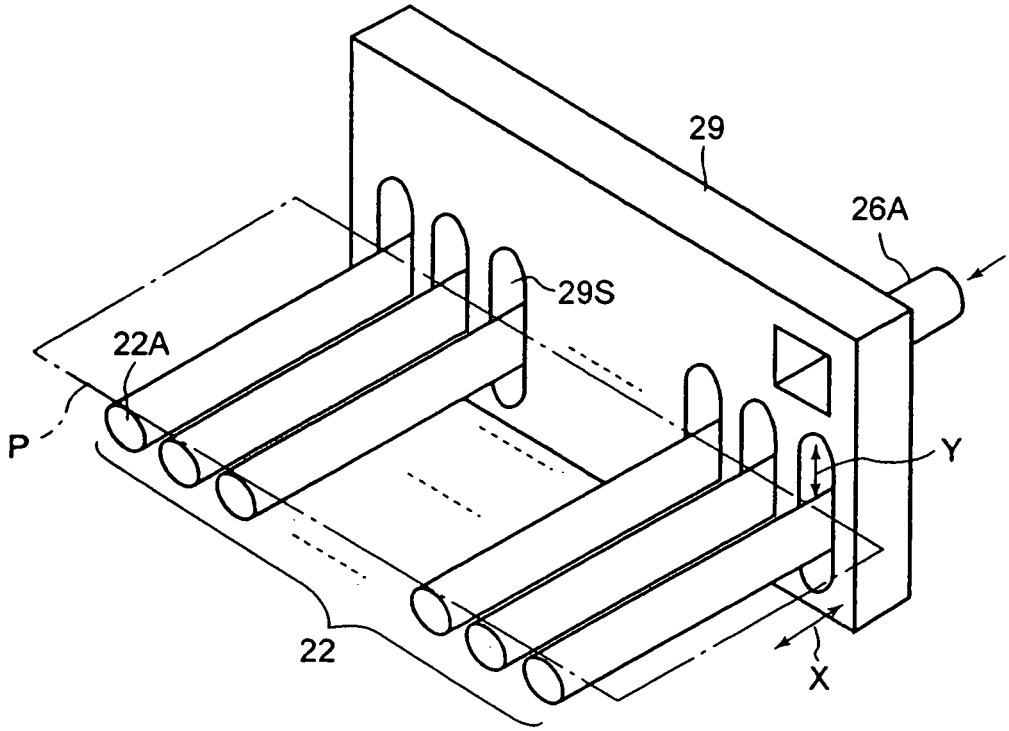
FIG. 4 is a schematic perspective view of a sheet-feeding member and a guide plate shown in FIG. 2.

The structure of sheet take-out apparatus 2 will be described with reference to FIGS. 2–4.

Sheet take-out apparatus 2 primarily consists of sheet feeder 20, depression unit 27, air spout unit 26 and take-out unit 30.

Sheet feeder 20 is provided with sheet-feeding member 22, movable sheet-feeding member 21 and upper surface position detection lever 23. A bundle of sheets are stacked on sheet-feeding member 22. Movable sheet-feeding member 21 is used to move sheet-feeding member 22 in a direction (e.g., an up and down direction) in parallel with the stacking direction of sheets P. Upper surface position detection lever 23 is a position sensor that detects the upper surface position (i.e., the top surface position) of the bundle of sheets stacked on sheet-feeding member 22. Upper surface position detection lever 23 converts the upper surface position into an electric signal and sends it to a controller not shown in the drawings. The controller controls movable sheet-feeding member 21 in response to the electric signal to move sheet-feeding member 22 so that it sets the top surface of sheets P to a fixed position in the vicinity of take-out unit 30.

Sheet feeder 20 is provided with front edge guide plate 24 fixed at the front portion of sheet-feeding member 22 on the front edge side along the longitudinal or taking-out direction of the stacked sheets. Front edge guide plate 24 performs to line up the front edge of sheets P and to adjust the posture of sheet P by guiding its lower side when take-out unit 30 delivers sheet P to conveyor 3.

Sheet feeder 20 is also equipped with rear edge guide plate 28 provided at the rear portion of sheet-feeding member 22, i.e., the rear edge side along the longitudinal or taking-out direction of the stacked sheets. Rear edge guide plate 28, which is movable along the longitudinal or taking-out direction of sheets P placed on sheet-feeding member 22 to adjust its own position depending on lengths of sheets P, controls a position of sheets P on the rear edge side.

Sheet feeder 20 further includes both-side guide plates 29 provided at both sides of sheet-feeding member 22 to guide the width of a bundle of sheets. Sheet-feeding member 22 consists of rod members 22A that are in parallel with each other and arranged to be on the same plane. Both-side guide plates 29 each are provided with slits 29S in which rod members 22A are movably held, respectively. The width of slit 29S is approximately the same as the diameter of rod member 22A while slit 29S is long in direction Y and rounded at both ends.

When rod members 22A of sheet-feeding member 22 are moved by movable sheet-feeding member 21, rod members 22A move along slits 29S in direction Y, i.e., in the sheet-stacking direction. Both-side guide plates 29 are movable in accordance with the width of a bundle of sheets in direction X while rod members 22A are kept engaged with slits 29S.

Depression unit 27 depresses a bundle of sheets against sheet-feeding member 22. Thus, depression unit 27 is provided with air nozzle 27A that spouts out air toward sheet-feeding member 22. Air nozzle 27A is fixed to face sheet-feeding member 22 so that it spouts out air to depresses the top one of stacked sheets P placed on the sheet-feeding member 22.

Air nozzle 27A is preferably disposed at a rear position from the center of a bundle of sheets stacked on sheet-feeding member 22. In the case that the stacked sheets are 120 mm through 170 mm long and 60 mm through 90 mm wide, the position toward which air nozzle 27A is directed is far by about 60 mm through about 85 mm or farther from the front edge of stacked sheets P and an air depression pressure against the sheet is set to 10 kPa through 15 kPa.

Air spout unit 26 also spouts out air to the front end side in the taking-out direction of the stacked sheets depressed by depression unit 27. Air spout unit 26 is provided with at least one of the first and second air nozzles 26A and 26B set in the vicinity of take-out unit 30.

In this embodiment, the first and second air nozzles 26A and 26B are disposed on both sides of the sheets stacked on sheet-feeding member 22, respectively. The first and second air nozzles 26A and 26B are fixed at both-side guide plates 29 and spout air at a pressure of 10 kPa through 15 kPa.

Thus, edge portions of the first and second air nozzles 26A and 26B are set to be movable as both-side guide plates 29 move to line up both edges of the sheets. With this structure, therefore, a gap defined between the side edge of the sheets and the edge portion of the first and second air nozzles 26A and 26B is so little that air does not escape somewhere else so much but is spouted securely to the sides of the sheets.

Here, the vicinity of take-out unit 30 with respect to positions of the first and second air nozzles 26A and 26B is defined to be a location that is closer to the front edge side of the sheets stacked on sheet-feeding member 22 than their center PC and that is in the vicinity where the top one of the sheets P contacts with take-out unit 30.

The first and second air nozzles 26A and 26B spout air from a compressor to separate the sheets from each other and to make some of them float. The air may be supplied to the first and second air nozzles 26A and 26B by one common compressor or separate ones.

As described above, since depression unit 27 depresses the rear edge side of the sheet stacked on sheet-feeding member 22 and air spout unit 26 spouts air to both sides of the sheets, the air remains at the front edge portion to keep the sheets P separate from each other.

Take-out unit 30 takes out a sheet from the front edge portion of the sheets in the longitudinal or taking-out direction while air spout unit 26 spouts air to the sheets. Take-out unit 30 is provided with take-out rotor 31 and reverse rotation rotor 32. Take-out rotor 31 rotates in the forward direction to take out a sheet on the top surface of the sheets as shown with an arrow in FIG. 2. Reverse rotation rotor 32 rotates in the direction to return excessive sheets taken out by take-out rotor 31 to sheet-feeding member 22 as also shown with an arrow in FIG. 2. Reverse rotation rotor 32 is provided underneath take-out rotor 31 and closer to sheet-feeding member 22 than to take-out rotor 31.

Take-out rotor 31 and reverse rotation rotor 32 are driven independently by rotation drive devices, respectively. A angular velocity ratio of take-out rotor 31 to reverse rotation rotor is set to approximately 10:7, for instance. In this embodiment, take-out rotor 31 with a diameter of 80 mm rotates at a speed of 1,200 r.p.m. (rotations per minute) while reverse rotation rotor 32 with a diameter of 40 mm rotates at a speed of 800 r.p.m.

Take-out rotor 31 and reverse rotation rotor 32 are provided with suction holes 31*a* and 32*a* made at their sheet-contacting surfaces to suck sheet P, respectively. Further, take-out rotor 31 is set to be substantially the same in suction pressure, e.g., 35 kPa through 40 kPa, as reverse rotation rotor 32.

Figure 5:
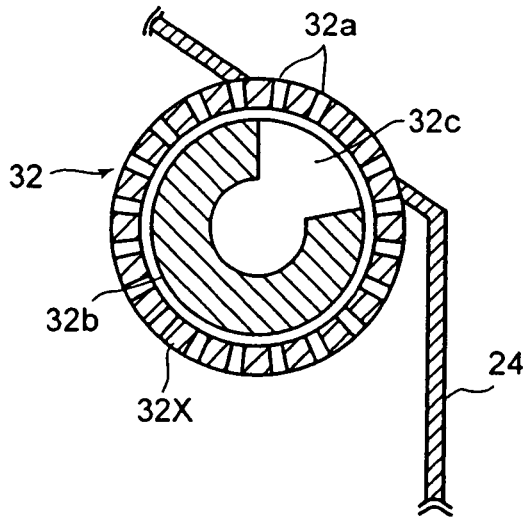
FIG. 5 is a schematic cross-sectional view of a reverse-rotation rotor shown in FIG. 2.

Since take-out rotor 31 is also substantially the same in structure as reverse rotation rotor 32, the structure of reverse rotation rotor 32 will be described below. As shown in FIG. 5, reverse rotation rotor 32 has cylinder-like rotor 32X and stator 32*b* in the inside of cylinder-like rotor 32X. Stator 32*b* is provided with cut-out portion 32*c* opposite to take-out rotor 31 to define a chamber.

With this structure, when cylinder-like rotor 32X rotates, only suction holes 32*a* facing cut-out portion 32*c* suck air so that sheet P sucked by suction holes 32*a* is conveyed back to sheet-feeding member 22 in the predetermined direction.

A friction coefficient of the surface of take-out rotor 31 is set to be larger than that of reverse rotation rotor 32. The surface of take-out rotor 31 is made of a rather high friction coefficient material such as rubber while that of reverse rotation rotor 32 is a metallic material such as stainless steel.

In take-out unit 30, take-out rotor 31 rotates to take out the top one of sheets P placed on sheet-feeding member 22. Thus, the sheet P in contact with the surface of take-out rotor 31 is taken out by the high friction.

Reverse rotation rotor 32, on the other hand, rotates in the direction to avoid sending out sheet P. Reverse rotation rotor 32 sucks, and returns to sheet feeder 20, sheets P that are not sucked by take-out rotor 31. Thus, this prevents take-out rotor 31 from delivering excessive sheets to conveyor 3. Take-out rotor 31 can take out sheets P at a speed of 275 m/sec, for instance.

A method of taking out sheets will be explained below with reference to sheet take-out apparatus 2 set forth above.

Figure 6:
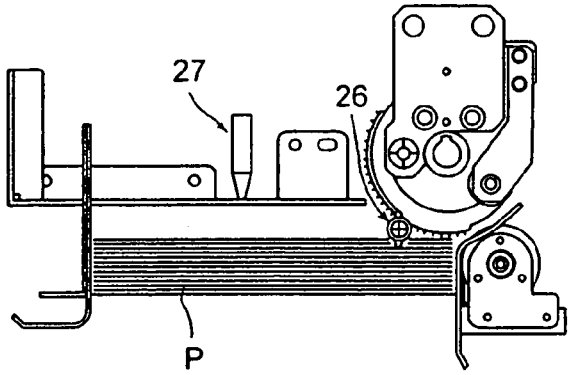
FIGS. 6–8 show schematic take-out operations of the sheet take-out apparatus shown in FIG. 2.

First, upper surface position detection lever 23 detects the upper surface of a bundle of sheets placed on sheet-feeding member 22. In response to detection results provided by upper surface position detection lever 23, movable sheet-feeding member 21 is controlled to lift up sheet-feeding member 22 until the upper surface of the sheets reaches a proper position as shown in FIG. 6.

When the upper surface of the sheets reach to the proper position, air nozzle 27A of depression unit 27 spouts air toward the sheets to depress the upper surface of the sheets in the direction against sheet-feeding member 22. At the same time, the first and second air nozzles 26A and 26B of air spout unit 26 spout air toward both sides of the sheets. The air causes sheets P to separate from each other and to float.

Figure 7:
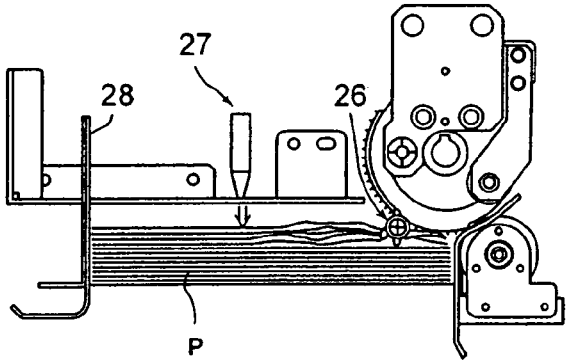

As shown in FIG. 7, several sheets P positioned at the upper part of the bundle of sheets float on the front edge side close to take-out unit 30 due to the air from the first and second air nozzles 26A and 26B while the air from air nozzle 27A prevents the rear edge portion of the sheets from floating. Since the sheets are depressed at the rear edge portion, the air spouted to the front edge side stays there to make the sheets P separate effectively.

Figure 8:
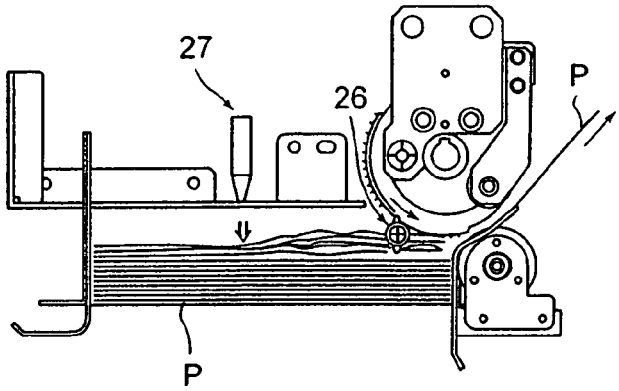

As shown in FIG. 8, when the sheets P are separated at the front edge of the sheets, the rotation drive devices rotate take-out rotor 31 and reverse rotation rotor 32 in the predetermined directions. Suction holes 31*a* of take-out rotor 31 sucks and takes out the separated sheet P while suction holes 32*a* of reverse rotation rotor 32 also sucks excessive sheets that are not sucked by suction holes 31*a* and returns them back to sheet feeder 20. This prevents take-out rotor 31 from taking out a plurality of sheets at a time.

Air spout unit 26 in the embodiment described above with reference to FIG. 2 is provided with a pair of air nozzles 26A and 26B at both sides of stacked sheets but it may be provided with either air nozzle 26A or 26B.

Figure 9:
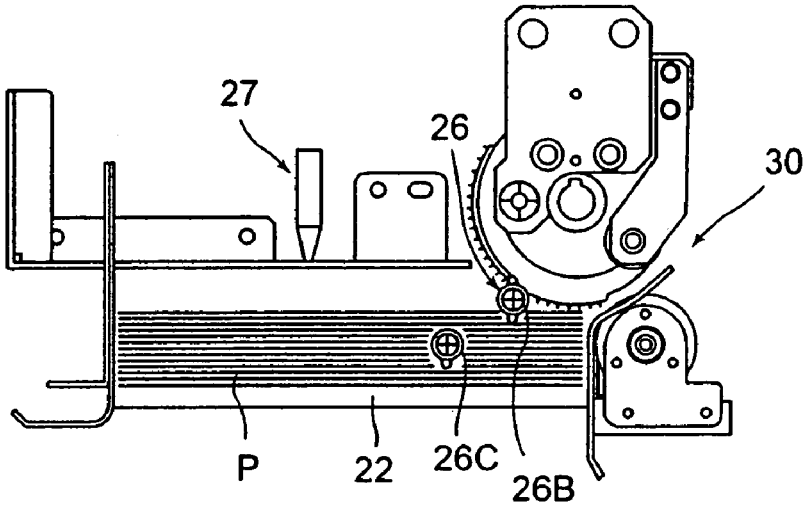
FIG. 9 is a schematic side view of a sheet take-out apparatus according to another embodiment of the present invention.
Figure 10:
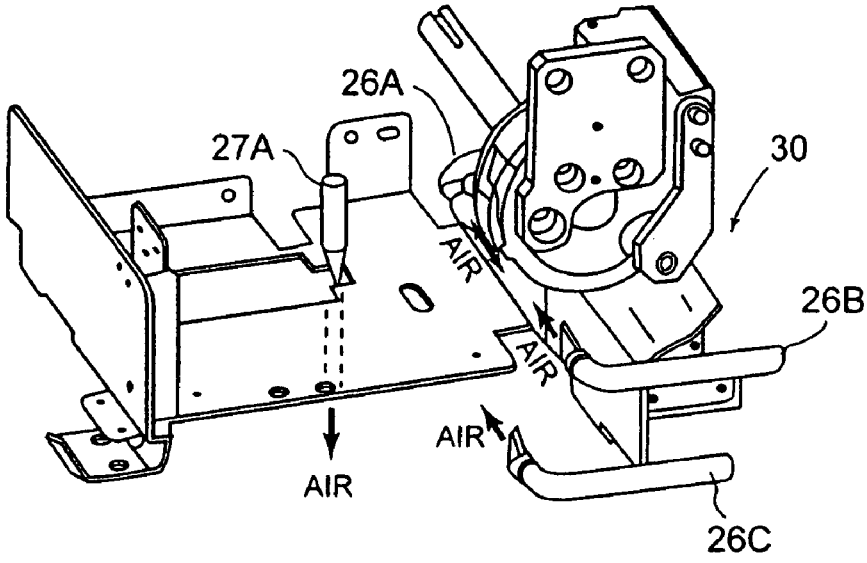
FIG. 10 is a schematic perspective view of the sheet take-out apparatus shown in FIG. 9.

As shown in FIGS. 9 and 10, however, in addition to the first and second air nozzles 26A and 26B, the third air nozzle 26C may be further provided at a place that is lower (closer to sheet-feeding member 22) than those of the first and second air nozzles 26A and 26B and that is on the rear edge side in the longitudinal or taking-out direction of the sheets. Air may be supplied to the third air nozzle 26C from the same compressor for the first and second air nozzles 26A and 26B or from a compressor different from it.

Air spout unit 26 provided with the three air nozzles can handle even the lower part of the sheets P and keep them separate from each other at the front edge portion of sheets P. Thus, take-out unit 30 is capable of avoiding taking out excessive sheets effectively.

As described above, in the sheet take-out apparatus and method of taking out sheets according to the embodiments, while a bundle of the sheets placed on the sheet-feeding member are depressed against the sheet-feeding member, air is spouted to the sides of a bundle of sheets in the longitudinal or taking-out direction. Thus, the air can be kept at the necessary portion of the sheets.

In other words, air is spouted from the upper position over the sheets to the rear edge portion of the sheets so that the rear edge of the sheets is depressed. Further, in this condition, air spouted to the front edge side of the sheets stay at the front edge side and keeps some sheets separate from each other at the front edge. Thus, irrespective of surface conditions of the sheets, the take-out of excessive sheets can be securely avoided.

The present invention provides a sheet take-out apparatus and a method of taking out sheets which are capable of taking out one necessary sheet at a time regardless of surface conditions of the sheets.

Although the invention has been described in its preferred form with a certain degree of particularity, it is understood that the present disclosure of the preferred form has been changed in the details of construction and the combination and arrangement of components may be resorted to without departing from the spirit and the scope of the invention as hereinafter claimed.

What is claimed is:

1. A sheet take-out apparatus comprising:

a sheet-feeding member on which sheets are placed;

an air spout unit to spout out air toward a right or left side of a front portion of said sheets with respect to a taking-out direction of said sheets in order for the front portion of said sheets to separate from each other;

a take-out unit to take out an uppermost sheet from said sheets in the taking-out direction when the air spouted out maintains the sheets separated from each other; and a depression member to depress said sheets against said sheet-feeding member from the uppermost sheet on a rear portion of said sheets located behind a central portion of said sheets with respect to the taking-out direction, wherein the sheet-feeding member includes a plurality of rod members that are arranged substantially parallel to one another in a same plane, the rod members being moveable along a direction substantially perpendicular to the plane.

2. A sheet take-out apparatus according to claim 1, wherein said air spout unit is an air nozzle provided in a vicinity of said take-out unit.

3. A sheet take-out apparatus according to claim 2, wherein said air spout unit includes first and second air nozzles provided on both sides of the sheets placed on said sheet-feeding member.

4. A sheet take-out apparatus comprising:

a sheet feeding member on which sheets are placed;

an air spout unit to spout air toward said sheets placed on said sheet-feeding member in order for the front portion of said sheets to separate from each other;

a take-out unit to take out an uppermost sheet from said sheets in a predetermined taking-out direction when the air spouted out maintains the sheets separated from each other; and a depression member to depress said sheets against said sheet-feeding member from the uppermost sheet on a rear portion of said sheets located behind a central portion of said sheets with respect to the taking-out direction, wherein said air spout unit includes first, second and third air nozzles spouting out air toward both sides of said sheets, said first and second air nozzles being provided in a vicinity of said take-out unit, said third air nozzle being provided rearwardly of said first and second air nozzles with respect to the taking-out direction, and wherein the sheet-feeding member includes a plurality of rod members that are arranged substantially parallel to one another in a same plane, the rod members being moveable along a direction substantially perpendicular to the plane.

5. A sheet take-out apparatus comprising:

a sheet-feeding member on which sheets are placed;

an air spout unit to spout out air toward a right or left side of a front portion of said sheets with respect to a taking-out direction of said sheets in order for the front portion of said sheets to separate from each other;

a take-out unit to take out an uppermost sheet from said sheets in the taking-out direction when the air spouted out maintains the sheets separated from each other; and an air jet nozzle to depress said sheets against said sheet-feeding member from the uppermost sheet on a rear portion of said sheets located behind a central portion of said sheets with respect to the taking-out direction, wherein the sheet-feeding member includes a plurality of rod members that are arranged substantially parallel to one another in a same plane, the rod members being moveable along a direction substantially perpendicular to the plane.

6. A sheet take-out apparatus according to claim 5, wherein a pointed end of said air jet nozzle is provided on a rear portion of said sheets that is farther from said take-out unit than the center of said sheets placed on said sheet-feeding member.

7. A sheet take-out apparatus comprising:

a sheet-feeding member on which sheets are placed;

an air spout unit to spout out air toward a right or left side of a front portion of said sheets with respect to a taking-out direction of said sheets in order for the front portion of said sheets to separated from each other; and a take-out unit having a take-out rotor to take out a top sheet and a reverse rotation rotor that rotates in reverse with respect to said take-out rotor and returns excessive sheets taken from said sheets to said sheet-feeding member; and an air depression member to depress said sheets by air against said sheet-feeding member from the top sheet on a rear portion of said sheets located behind a central portion of said sheets with respect to the taking-out direction when the air spout unit maintains the sheets separate from each other, wherein the sheet-feeding member includes a plurality of rod members that are arranged substantially parallel to one another in a same plane, the rod members being moveable along a direction substantially perpendicular to the plane.

8. A sheet take-out apparatus according to claim 7, wherein said take-out rotor and said reverse rotation rotor each are provided with surfaces in which suction holes are defined to suck a sheet from said sheets.

9. A sheet take-out apparatus according to claim 8, wherein a friction coefficient of said surface of said take-out rotor is larger than that of said surface of said reverse rotation rotor.

10. A sheet take-out apparatus according to claim 8, wherein said air spout unit is attached to said guide members.

11. A sheet take-out apparatus comprising:

a sheet-feeding member on which sheets are placed;

guide members provided on both sides of the sheets placed on said sheet-feeding member to adjust a position of said sheets in a width direction thereof;

an air spout unit to spout out air toward a right or left side of a front portion of said sheets with respect to a taking-out direction of said sheets in order for the front portion of said sheets to separate from each other;

a take-out unit to take out an uppermost sheet from said sheets in the taking-out direction when the air spouted out maintains the sheets separated from each other; and an air depression member to depress said sheets by air against said sheet-feeding member from the uppermost sheet on a rear portion of said sheets located behind a central portion of said sheets with respect to the taking-out direction, wherein the sheet-feeding member includes a plurality of rod members that are arranged substantially parallel to one another in a same plane, the rod members being moveable along a direction substantially perpendicular to the plane.

12. A method of taking out a sheet from stacked sheets comprising:

placing stacked sheets on a sheet-feeding member;

spouting out air toward a right or left side of a front portion of said stacked sheets with respect to a taking-out direction of said sheets in order for the front portion of said sheets to separate from each other;

taking out an uppermost sheet from said stacked sheets in the taking-out direction when the air spouted out maintains the sheets separated from each other; and depressing said stacked sheets against said sheet-feeding member from the uppermost sheet on a rear portion of said sheets located behind a central portion of said stacked sheets with respect to the taking-out direction, wherein the sheet-feeding member includes a plurality of rod members that are arranged substantially parallel to one another in a same plane, the rod members being moveable along a direction substantially perpendicular to the plane.

* * * * *